US008192912B2

(12) United States Patent
Sacripante et al.

(10) Patent No.: US 8,192,912 B2
(45) Date of Patent: Jun. 5, 2012

(54) CURABLE TONER COMPOSITIONS AND PROCESSES

(75) Inventors: Guerino G. Sacripante, Oakville (CA); Nathan C. Dyck, Oakville (CA); Daryl W. Vanbesien, Burlington (CA); Edward G. Zwartz, Mississauga (CA); Cuong Vong, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 572 days.

(21) Appl. No.: 12/437,582

(22) Filed: May 8, 2009

(65) Prior Publication Data

US 2010/0285403 A1 Nov. 11, 2010

(51) Int. Cl.
*G03G 9/08* (2006.01)

(52) U.S. Cl. ..... 430/137.12; 430/137.14

(58) Field of Classification Search ..... 430/137.12, 430/137.14

See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,720,617 | A | 3/1973 | Chatterji et al. |
| 3,847,604 | A | 11/1974 | Hagenbach et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,295,990 | A | 10/1981 | Verbeek et al. |
| 4,394,430 | A | 7/1983 | Jadwin et al. |
| 4,560,635 | A | 12/1985 | Hoffend et al. |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |

(Continued)

FOREIGN PATENT DOCUMENTS

EP 1 793 281 A1 6/2007

(Continued)

OTHER PUBLICATIONS

English abstract of KR 703972, Apr. 2007.*

(Continued)

*Primary Examiner* — Hoa V Le
(74) *Attorney, Agent, or Firm* — Eugene O. Palazzo

(57) ABSTRACT

Processes for producing emulsion aggregation toners are provided. In embodiments, methods of the present disclosure may be utilized to produce toners suitable for low melt applications, including use in flexible packaging applications, where low pile height is desired for low cost and flexibility. In embodiments, the EA toners may be prepared by optimizing the particle size of the emulsion, the choice of and amount of aggregating agent utilized, and the solids content of the emulsion.

20 Claims, 4 Drawing Sheets

U.S. PATENT DOCUMENTS

| | | | |
|---|---|---|---|
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,905,012 | A | 5/1999 | De Meutter et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 6,004,714 | A | 12/1999 | Ciccarelli et al. |
| 6,063,827 | A | 5/2000 | Sacripante et al. |
| 6,190,815 | B1 | 2/2001 | Ciccarelli et al. |
| 6,593,049 | B1 | 7/2003 | Veregin et al. |
| 6,730,450 | B1 | 5/2004 | Moffat et al. |
| 6,743,559 | B2 | 6/2004 | Combes et al. |
| 6,756,176 | B2 | 6/2004 | Stegamat et al. |
| 6,780,500 | B2 | 8/2004 | Cumouchel |
| 6,830,860 | B2 | 12/2004 | Sacripante et al. |
| 7,029,817 | B2 | 4/2006 | Robinson et al. |
| 7,141,761 | B1 | 11/2006 | Dirubio et al. |
| 2005/0137278 | A1 | 6/2005 | Fromm |
| 2006/0110674 | A1 | 5/2006 | Maehata et al. |
| 2006/0216625 | A1 | 9/2006 | Maehata et al. |
| 2006/0222991 | A1 | 10/2006 | Sacripante et al. |
| 2006/0292477 | A1* | 12/2006 | Daimon et al. ..... 430/109.4 |
| 2008/0199797 | A1 | 8/2008 | Sacripante et al. |

FOREIGN PATENT DOCUMENTS

| | | | |
|---|---|---|---|
| EP | 1 959 304 | A2 | 8/2008 |
| KR | 703972 | * | 4/2007 |

OTHER PUBLICATIONS

Machine English language translation fo KR 703972, Apr. 2007.*
European Search Report dated Sep. 1, 2010 for copending European Appln. No. 10160897.0.
European Search Report dated Aug. 30, 2010 for copending European Appln. No. 10160899.0.

* cited by examiner

CURABLE TONER COMPOSITIONS AND PROCESSES

BACKGROUND

This disclosure is generally directed to toner processes, and more specifically, emulsion aggregation and coalescence processes, as well as toner compositions formed by such processes and development processes using such toners.

Emulsion aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817.

The disclosures of each of the foregoing patents and publications are hereby incorporated by reference herein in their entireties. The appropriate components and process aspects of the each of the foregoing patents and publications may also be selected for the present compositions and processes in embodiments thereof.

Electrophotographic digital printing with conventional toners, including those of about 8 micron size, may result in very high pile heights for high surface coverage, for example, from about 12 microns to about 14 microns of height for surface area coverage of from about 300% to about 400%. When printed onto thin flexible packaging substrates, this large toner pile height may result in a wavy rewound roll. This wavy roll may be unusable for subsequent flexible packaging operations.

Thus, there remains a need for small size emulsion aggregation (EA) toners having a size of from about 3 microns to about 4 microns, which may be suitable for flexible packaging applications.

SUMMARY

Utilizing the methods of the present disclosure, one may develop toners suitable for low melt applications, including use in flexible packaging applications, where low pile height is desired for low cost and flexibility. In embodiments, the EA toners may be prepared by optimizing the particle size of the emulsion, the choice of and amount of aggregating agent utilized, and the solids content of the emulsion.

In embodiments, a process of the present disclosure may include contacting an emulsion comprising at least one amorphous polyester resin in combination with at least one crystalline polyester resin with an optional wax and an optional colorant, the emulsion having a particle size of from about 50 nm to about 200 nm and a solids content of from about 10% to about 50% by weight; aggregating the particles by contacting the particles with from about 0.1 parts per hundred to about 2 parts per hundred of an aggregating agent selected from the group consisting of aluminum sulfate, polyaluminum chloride, polyaluminum bromide, polyaluminum fluoride, polyaluminum iodide, polyaluminum silicate, polyaluminum sulfosilicate, aluminum chloride, aluminum nitrite, aluminum sulfate, potassium aluminum sulfate, and combinations thereof to form aggregated particles; contacting the aggregated particles with at least one unsaturated polymeric resin in combination with a photoinitiator to form a shell over the aggregated particles; coalescing the aggregated particles to form toner particles; and recovering the toner particles.

In other embodiments, a process of the present disclosure may include contacting an emulsion comprising at least one amorphous polyester resin in combination with at least one crystalline polyester resin with an optional wax and an optional colorant, the emulsion having a particle size of from about 50 nm to about 200 nm and a solids content of from about 10% to about 50% by weight; aggregating the particles by contacting the particles with from about 0.1 parts per hundred to about 2 parts per hundred of an aggregating agent selected from the group consisting of aluminum sulfate, polyaluminum chloride, polyaluminum bromide, polyaluminum fluoride, polyaluminum iodide, polyaluminum silicate, polyaluminum sulfosilicate, aluminum chloride, aluminum nitrite, aluminum sulfate, potassium aluminum sulfate, and combinations thereof to form aggregated particles; contacting the aggregated particles with at least one unsaturated polymeric resin in combination with a photoinitiator to form a shell over the aggregated particles; coalescing the aggregated particles to form toner particles; recovering the toner particles; applying the toner particles to a substrate; and fusing the toner particles to the substrate by non-contact fusing to form an image on the substrate, wherein the toner has a gloss of from about 20 ggu to about 100 ggu and the image on the substrate has a toner pile height of from about 1 micron to about 6 microns.

BRIEF DESCRIPTION OF THE DRAWINGS

Various embodiments of the present disclosure will be described herein below with reference to the figures wherein.

DETAILED DESCRIPTION

Figure 1A:
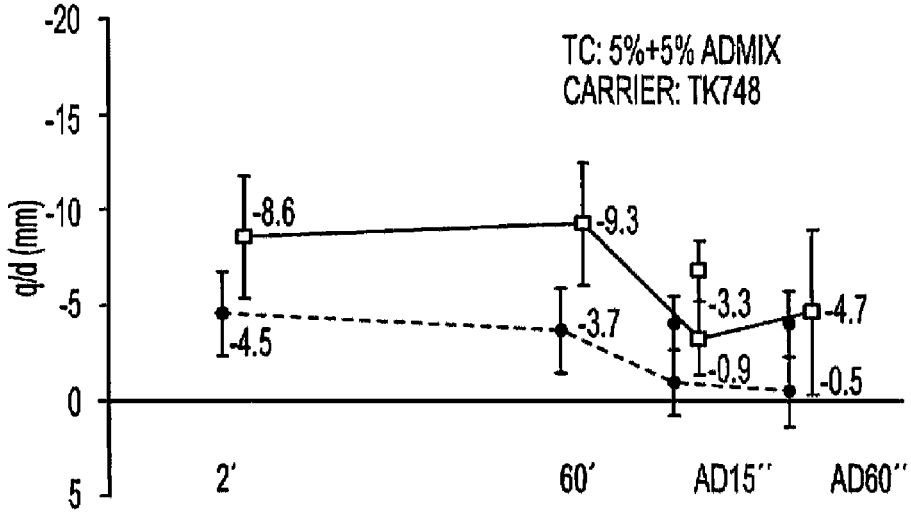
FIGS. 1A-1D are graphs depicting charge and cohesion data for toners of the present disclosure.
Figure 1B:
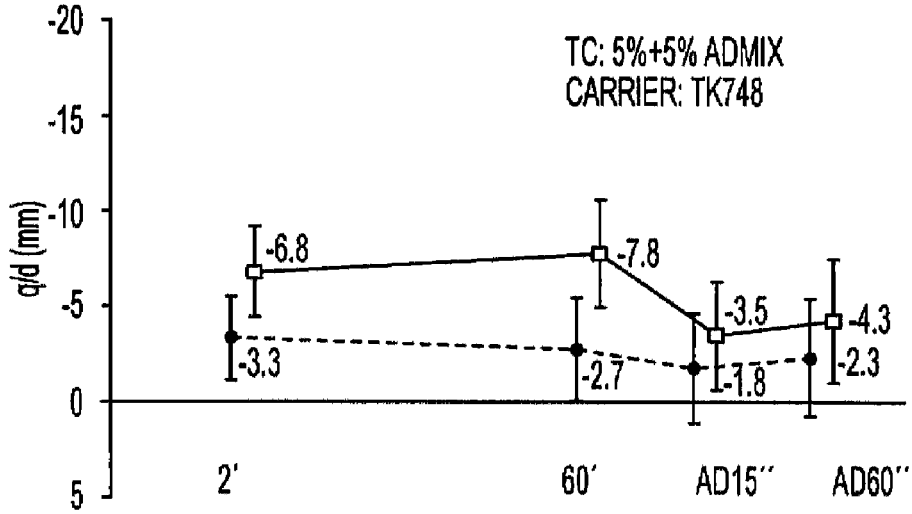
Figure 1C:
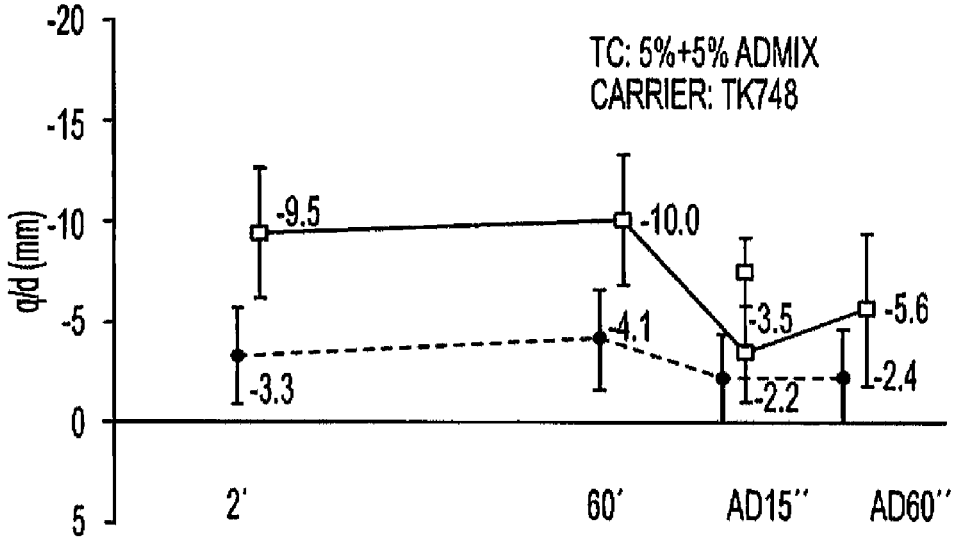
Figure 1D:
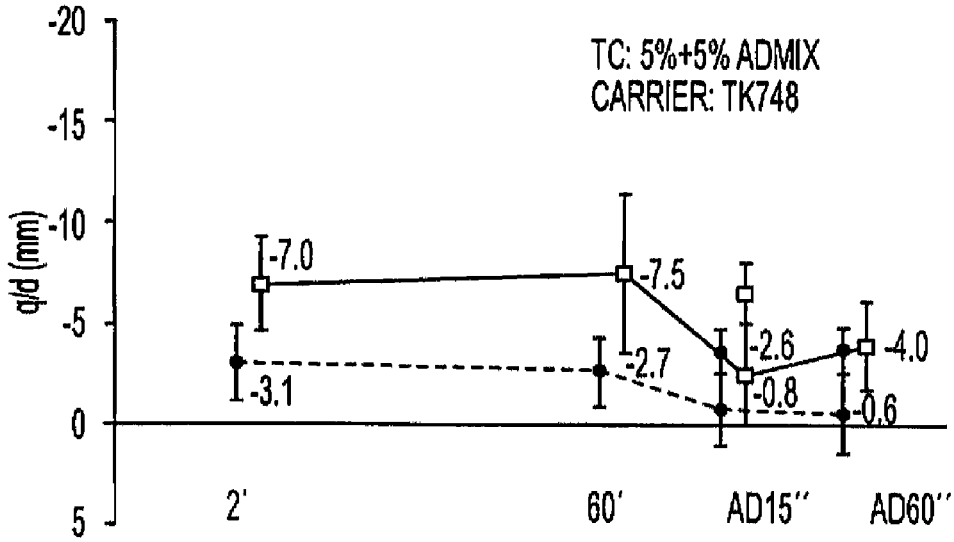

In accordance with the present disclosure, small particle sized low melt EA toners are provided which include unsaturated resins in combination with at least one ultraviolet (UV) initiator. These toners may be utilized in non-contact fusing applications. In embodiments, toner particles of the present disclosure may possess a core/shell configuration.

In embodiments the present disclosure is directed to curable toner compositions, including those made by a chemical process such as emulsion aggregation, wherein the resultant toner composition includes an unsaturated polyester resin, a photoinitiator, optionally a wax, and optionally a colorant.

Processes of the present disclosure may include aggregating latex particles, such as latexes containing an unsaturated resin such as unsaturated crystalline or amorphous polymeric particles such as polyesters, a photoinitiator, optionally a wax, and optionally a colorant, in the presence of a coagulant.

A number of advantages are associated with the toner obtained by the processes and toner compositions illustrated herein. The process allows for particles to be prepared in the size of 2.5 to 4.2 microns in diameter, in embodiments from about 3 to about 4 microns, in embodiments about 3.5, with narrow size distributions, sometimes referred to as a narrow Geometric Standard Deviation (GSD), of from about 1.2 to about 1.25, without the use of classifiers. Furthermore, low melting or ultra-low melting fixing temperatures can be obtained by the use of crystalline resins in the toner composition. The aforementioned low fixing temperatures allow for the curing by ultraviolet light to occur a lower temperatures, such as from about 120° C. to about 135° C. The toner compositions provide other advantages, such as high temperature document offset properties, such as up to about 85° C., as well as resistance to organic solvents such as methyl ethyl ketone (MEK).

In embodiments, toners prepared in accordance with the present disclosure may be UV curable low melt EA toners including an unsaturated resin, UV initiator and a shell. Adding a photoinitiator to the resin may produce a UV curable toner. While toners of the present disclosure may include photoinitiators used with UV light, it has been found that UV curing may not be required as non-contact fusing with different wavelength infrared (IR) emitters may occur.

In accordance with the present disclosure, the desired toners may be obtained by optimizing the particle size of the emulsion, the use of an appropriate aggregating agent, and the solids content of the emulsion.

Resin

Toners of the present disclosure may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

(butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin utilized in the core may be linear.

In embodiments, a suitable amorphous polyester resin may be a poly(propoxylated bisphenol A co-fumarate) resin having the following formula (I):

(I)

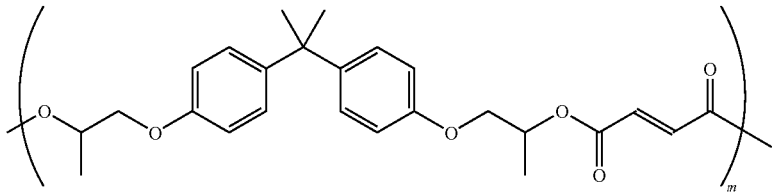

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate) -copoly(propylene-diethylene-5-sulfoisophthalate), copoly(propylene-butylene-terephthalate) -copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

In embodiments, a suitable amorphous resin utilized in a toner of the present disclosure may have a weight average molecular weight (Mw) of from about 10,000 to about 100,000, in embodiments from about 15,000 to about 30,000.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

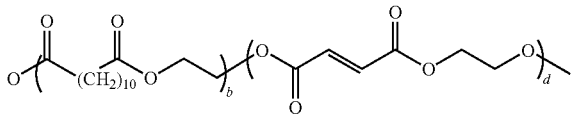

wherein b is from about 5 to about 2000 and d is from about 5 to about 2000.

In embodiments, a suitable crystalline resin utilized in a toner of the present disclosure may have a molecular weight of from about 10,000 to about 100,000, in embodiments from about 15,000 to about 30,000.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

In embodiments, a suitable toner of the present disclosure may include 2 amorphous polyester resins and a crystalline polyester resin. The weight ratio of the three resins may be from about 29% first amorphous resin/69% second amorphous resin/2% crystalline resin, to about 60% first amorphous resin/20% second amorphous resin/20% crystalline resin.

As noted above, in embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, or preferably from about 75 to about 85 percent by weight of the toner particles (that is, toner particles exclusive of external additives) on a solids basis. The ratio of crystalline resin to amorphous resin can be in the range from about 1:99 to about 30:70, such as from about 5:95 to about 25:75, in some embodiments from about 5:95 to about 15:95.

It has also been found that a polymer with a low acid number provides better crosslinking results under irradiation. For example, it may be useful in embodiments that the acid number of the polymer be from about 0 to about 40 mg KOH/gram, such as from about 1 to about 30 mg KOH/gram, in embodiments from about 10 to about 20 mg KOH/gram.

Photoinitiator

To enable curing of the unsaturated polymer, the toners of the present disclosure may also contain a photoinitiator. Suitable photoinitiators include UV-photoinitiators including, but not limited to, hydroxycyclohexylphenyl ketones; other ketones such as alpha-amino ketone and 4-(2-hydroxyethoxy)phenyl-(2-hydroxy-2-propyl) ketone; benzoins; benzoin alkyl ethers; benzophenones, such as 2,4,6-trimethylbenzophenone and 4-methylbenzophenone; trimethylbenzoylphenylphosphine oxides such as 2,4,6-trimethylbenzoyl-diphenyl-phosphine oxide or phenylbis(2,4,6-trimethylvbenzyoyl) phosphine oxide (BAPO) available as IRGACURE® 819 from Ciba; azo compounds; anthraquinones and substituted anthraquinones, such as, for example, alkyl substituted or halo substituted anthraquinones; other substituted or unsubstituted polynuclear quinines; acetophenones, thioxanthones; ketals; acylphosphines; and mixtures thereof. Other examples of photoinitiators include, but not limited to, 2-hydroxy-2-methyl-1-phenyl-propan-1-one and 2-isopropyl-9H-thioxanthen-9-one. In embodiments, the photoinitiator is one of the following compounds or a mixture thereof: a hydroxycyclohexylphenyl ketone, such as, for example, 2-Hydrox-4'-hydroxyethoxy-2-methylpropiophenone or 1-hydroxycyclohexylphenyl ketone, such as, for example, IRGACURE® 184 (Ciba-Geigy Corp., Tarrytown, N.Y.), having the structure:

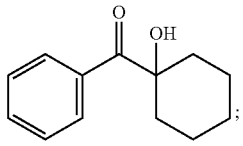

a trimethylbenzoylphenylphosphine oxide, such as, for example, ethyl-2,4,6-trimethylbenzoylphenylphosphinate, such as, for example, LUCIRIN® TPO-L (BASF Corp.), having the formula

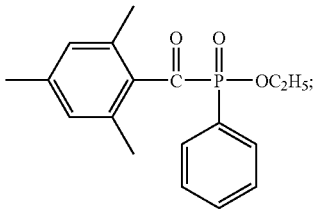

a mixture of 2,4,6-trimethylbenzophenone and 4-methylbenzophenone, such as, for example, SARCURE™ SR 137 (Sartomer); a mixture of 2,4,6-trimethylbenzoyl-diphenyl-phosphine oxide and 2-hydroxy-2-methyl-1-phenyl-propan-1-one, such as, for example, DAROCUR® 4265 (Ciba Specialty Chemicals); alpha-amino ketone, such as, for example, IRGACURE® 379 (Ciba Specialty Chemicals); 4-(2-hydroxyethoxy)phenyl-(2-hydroxy-2-propyl) ketone, such as, for example, IRGACURE® 2959 (Ciba Specialty Chemicals); 2-isopropyl-9H-thioxanthen-9-one, such as, for example, DAROCUR® ITX (Ciba Specialty Chemicals); and mixtures thereof.

In embodiments, the toner composition contains from about 0.5 to about 15 wt % photoinitiator, such as a UV-photoinitiator, in embodiments from about 1 to about 14 wt %, or from about 3 to about 12 wt %, photoinitiator.

Toner

The resin of the resin emulsions described above, in embodiments a polyester resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991 K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

In addition to the polymer binder resin and photoinitiator, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Optionally, a wax may also be combined with the resin and UV additive in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 9™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1 parts per hundred (pph) to about 1 pph, in embodiments from about 0.25 pph to about 0.75 pph, in some embodiments about 0.5 pph. This provides a sufficient amount of agent for aggregation.

The gloss of a toner may be influenced by the amount of retained metal ion, such as $Al^{3+}$, in the particle. The amount of retained metal ion may be further adjusted by the addition of EDTA. In embodiments, the amount of retained crosslinker, for example $Al^{3+}$, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

In embodiments, the aggregate particles may be of a size of less than about 3 microns, in embodiments from about 2 microns to about 3 microns, in embodiments from about 2.5 microns to about 2.9 microns.

Shell Resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

The shell resin may be present in an amount of from about 10 percent to about 32 percent by weight of the toner particles, in embodiments from about 24 percent to about 30 percent by weight of the toner particles. In embodiments a photoinitiator as described above may be included in the shell. Thus, the photoinitiator may be in the core, the shell, or both. The photoinitiator may be present in an amount of from about 1 percent to about 5 percent by weight of the toner particles, in embodiments from about 2 percent to about 4 percent by weight of the toner particles.

Emulsions including these resins may have a solids loading of from about 5% solids by weight to about 20% solids by weight, in embodiments from about 12% solids by weight to about 17% solids by weight, in embodiments about 13% solids by weight.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

In accordance with the present disclosure, while the initial solids content of the emulsion could be from about 5% to about 15%, in embodiments from about 7.5% to about 12.5%, in some embodiments about 10%, during shell addition and coalescence, it was surprisingly found that the particles could only be stabilized and coalesced to narrow size distributions by increasing the solids loading of the emulsion to at least about 13% solids, in embodiments from about 13% to about 20%, in other embodiments from about 14% to about 17%.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g.

Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 90 ggu.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 2.5 to about 20 μm, in embodiments from about 2.75 to about 10 μm, in other embodiments from about 3 to about 7.5 μm.

(2) Number Average Geometric Standard Deviation (GSDn) and/or Volume Average Geometric Standard Deviation (GSDv) of from about 1.18 to about 1.30, in embodiments from about 1.21 to about 1.24.

(3) Circularity of from about 0.9 to about 1 (measured with, for example, a Sysmex FPIA 2100 analyzer), in embodiments form about 0.95 to about 0.985, in other embodiments from about 0.96 to about 0.98.

(4) Glass transition temperature of from about 45° C. to about 60° C., in embodiments from about 48° C. to about 55° C.

(5) The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It may be desirable in embodiments that the toner particle possess separate crystalline polyester and wax melting points and amorphous polyester glass transition temperature as measured by DSC, and that the melting temperatures and glass transition temperature are not substantially depressed by plasticization of the amorphous or crystalline polyesters, or by the photoinitiator, or by the wax. To achieve non-plasticization, it may be desirable to carry out the emulsion aggregation at a coalescence temperature of less than the melting point of the crystalline component, photoinitiator and wax components.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments, the fusing of the toner image can be conducted by any conventional means, such as combined heat and pressure fusing such as by the use of heated pressure rollers. Such fusing steps can include an irradiation step, such as an ultraviolet irradiation step, for activating the photoinitiator and causing crosslinking or curing of the unsaturated polymer contained in the toner composition. This irradiation step can be conducted, for example, in the same fusing housing and/or step where conventional fusing is conducted, or it can be conducted in a separate irradiation fusing mechanism and/or step. In some embodiments, this irradiation step may provide non-contact fusing of the toner, so that conventional pressure fusing may not be required.

For example, in embodiments, the irradiation can be conducted in the same fusing housing and/or step where conventional fusing is conducted. In embodiments, the irradiation fusing can be conducted substantially simultaneously with conventional fusing, such as be locating an irradiation source immediately before or immediately after a heated pressure roll assembly. Desirably, such irradiation is located immediately after the heated pressure roll assembly, such that crosslinking occurs in the already fused image.

In other embodiments, the irradiation can be conducted in a separate fusing housing and/or step from a conventional fusing housing and/or step. For example, the irradiation fusing can be conducted in a separate housing from the conventional such as heated pressure roll fusing. That is, the conventionally fused image can be transported to another development device, or another component within the same development device, to conduct the irradiation fusing. In this manner, the irradiation fusing can be conducted as an optional step, for example to irradiation cure images that require improved high temperature document offset properties, but not to irradiation cure images that do not require such improved high temperature document offset properties. The conventional fusing step thus provides acceptable fixed image properties for moist applications, while the optional irradiation curing can be conducted for images that may be exposed to more rigorous or higher temperature environments.

In other embodiments, the toner image can be fused by irradiation and optional heat, without conventional pressure fusing. This may be referred to, in embodiments, as noncontact fusing. The irradiation fusing can be conducted by any suitable irradiation device, and under suitable parameters, to cause the desired degree of crosslinking of the unsaturated polymer. Suitable non-contact fusing methods are within the purview of those skilled in the art and include, in embodiments, flash fusing, radiant fusing, and/or steam fusing.

In embodiments, the energy source for fusing can be actinic, such as radiation having a wavelength in the ultraviolet or visible region of the spectrum, accelerated particles, such as electron beam radiation, thermal such as heat or infrared radiation, or the like. In embodiments, the energy may be actinic radiation. Suitable sources of actinic radiation include, but are not limited to, mercury lamps, xenon lamps, carbon arc lamps, tungsten filament lamps, lasers, sunlight, and the like.

In other embodiments, non-contact fusing may occur by exposing the toner to infrared light at a wavelength of from about 750 nm to about 4000 nm, in embodiments from about 900 to about 3000 nm, for a period of time of from about 20 milliseconds to about 4000 milliseconds, in embodiments from about 500 milliseconds to about 1500 milliseconds.

Where heat is also applied, the image can be fused by irradiation such as by ultraviolet or infrared light, in a heated environment such as from about 100 to about 250° C., such as from about 125 to about 225° C. or from about 150 or about 160 to about 180 or about 190° C.

Exemplary apparatuses for producing these images may include, in embodiments, a heating device possessing heating elements, an optional contact fuser, a non-contact fuser such as a radiant fuser, an optional substrate pre-heater, an image bearing member pre-heater, and a transfuser. Examples of such apparatus include those disclosed in U.S. Pat. No. 7,141,761, the disclosure of which is hereby incorporated by reference in its entirety.

In embodiments, a suitable electrostatographic apparatus for use with a toner of the present disclosure may include a housing defining a chamber for storing a supply of toner therein; an advancing member for advancing the toner on a surface thereof from the chamber of said housing in a first direction toward a latent image; a transfer station for transferring toner to a substrate, in embodiments a flexible substrate, the transfer station including a transfer assist member for providing substantially uniform contact between said print substrate and the image-retentive member; a developer unit possessing toner for developing the latent image; and a fuser member for fusing said toner to said flexible substrate, in embodiments utilizing light as described above.

When the irradiation fusing is applied to the photoinitiator-containing toner composition, the resultant fused image is provided with non document offset properties, that is, the image does not exhibit document offset, at temperature up to about 90° C., such as up to about 85° C. or up to about 80° C. The resultant fused image also exhibits improved abrasion resistance and scratch resistance as compared to conventional fused toner images. Such improved abrasion and scratch resistance is beneficial, for example, for use in producing book covers, mailers, and other applications where abrasion and scratches would reduce the visual appearance of the item. Improved resistance to solvents is also provided, which is also beneficial for such uses as mailers, and the like. These properties are particularly helpful, for example, for images that must withstand higher temperature environments, such as automobile manuals that typically are exposed to high temperatures in glove compartments or printed packaging materials that must withstand heat sealing treatments.

In embodiments, UV radiation may be applied, either separately for fusing, or in combination with IR light as described above. Ultraviolet radiation, in embodiments from a medium pressure mercury lamp with a high speed conveyor under UV light, such as about 20 to about 70 m/min., can be used, wherein the UV radiation is provided at a wavelength of about 200 to about 500 nm for about less than one second. In embodiments, the speed of the high speed conveyor can be about 15 to about 35 m/min. under UV light at a wavelength of about 200 to about 500 nm for about 10 to about 50 milliseconds (ms). The emission spectrum of the UV light source generally overlaps the absorption spectrum of the UV-initiator. Optional curing equipment includes, but is not limited to, a reflector to focus or diffuse the UV light, and a cooling system to remove heat from the UV light source. Of course, these parameters are exemplary only, and the embodiments are not limited thereto. Further, variations in the process can include such modifications as light source wavelengths, optional pre-heating, alternative photoinitiators including use of multiple photoinitiators, and the like.

Thus, light to be applied to fuse an image to a substrate may be from about 200 nm to about 4000 nm.

It is envisioned that the toners of the present disclosure may be used in any suitable procedure for forming an image with a toner, including in applications other than xerographic applications.

Utilizing the toners of the present disclosure, images may be formed on substrates, including flexible substrates, having a toner pile height of from about 1 micron to about 6 microns, in embodiments from about 2 microns to about 4 microns.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

Preparation of an amorphous resin-photoinitiator emulsion. About 816.67 grams of ethyl acetate was added to about 125 grams of a poly(propoxylated bisphenol A co-fumarate) resin having the following formula (I):

(I)

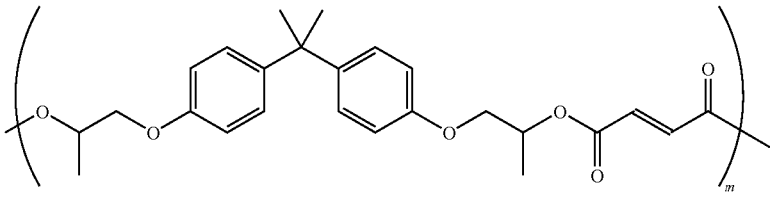

wherein m may be from about 5 to about 1000, with a glass transition temperature of about 56° C.

A 1 liter kettle, equipped with a mechanical stirrer and distillation apparatus, was charged with about 192 grams of the above polyester, obtained from Reichold, with an acid value of about 14.08 g/KOH, about 8 grams of IRGACURE 814, obtained from Ciba Geigy, about 100 grams of methyl ethyl ketone (MEK), and about 2.5 grams of isopropanol. The mixture was stirred at about 350 rpm for about 3 hours at about 45° C., during which the resin and photoinitiator were fully dissolved in the organic solvent. To this mixture was then added about 9 grams of a 10% aqueous ammonium hydroxide solution over a 10 minute period, followed by adding about 600 grams of water (drop-wise utilizing a pump) at a rate of about 4 grams per minute, resulting with a polyester dispersion. The reactor was then heated to about 85° C. to distill off the organic solvent. The resulting resin dispersion included about 24.47% solids by weight in water, with a volume average diameter of about 138.8 nanometers as measured with a HONEYWELL MICROTRAC® UPA150 particle size analyzer.

Example 2

Preparation of a crystalline resin emulsion. About 816.67 grams of ethyl acetate was added to about 125 grams of a copoly(ethylene-dodecanoate)-copoly(ethylene-fumarate) resin having the following formula (II):

(II)

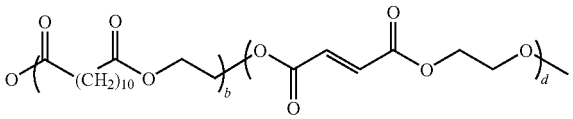

wherein b was from about 5 to about 2000 and d was from about 5 to about 2000.

The resin was dissolved by heating to about 65° C. on a hot plate and stirring at about 200 rpm Once the solutions had reached about 65° C., in a separate 4 liter glass reactor vessel, about 3.05 grams (for an acid number of about 17) of sodium bicarbonate was added to about 708.33 grams of deionized water. This aqueous solution was heated to about 65° C. on a hot plate stirring at about 200 rpm. The dissolved resin and ethyl acetate mixture was slowly poured into the 4 liter glass reactor containing this aqueous solution with homogenization at about 4,000 rpm. The homogenizer speed was then increased to about 10,000 rpm and left for about 30 minutes.

The homogenized mixture was placed in a heat jacketed PYREX distillation apparatus, with stirring at about 200 rpm. The temperature was ramped up to about 80° C. at a rate of about 1° C./minute. The ethyl acetate was distilled from the mixture at about 80° C. for about 120 minutes. The mixture was cooled to below about 40° C. then screened through a 20 micron screen. The mixture was pH adjusted to about 7 using about 4% NaOH solution and centrifuged.

The resulting resin dispersion included about 33.5% solids by weight in water, with a volume average diameter of about 205 nanometers as measured with a HONEYWELL MICROTRAC® UPA150 particle size analyzer.

Example 3

An emulsion aggregation toner was prepared having about 82% of the polyester-photoinitiator resin of Example 1, about 12% of a crystalline polyester resin, and about 6.0% of a cyan pigment, Pigment Blue 15:3. The toner had about 28% of the polyester-photoinitiator resin in the shell.

A 2 liter kettle was charged with about 224 grams of the polyester emulsion of Example 1 (about 24.47% solids and having a particle size of about 138.8 nm). To this was added about 44.8 grams of a cyan pigment dispersion of about 15% solids available from Sun Chemicals as Pigment Blue 15:3, about 175 grains of Millipore water, and about 2.9 grams of DOWFAX™ 2A1 surfactant (an alkyldiphenyloxide disulfonate from the Dow Chemical Company) (about 47.1% aqueous solution), with stirring at about 100 rpm. To this mixture was added about 34.9 grams of the crystalline polyester resin emulsion of Example 2, with a solids content of about 33.5%. To this was then added 0.3 M nitric acid solution, until a pH of about 4.2 was achieved, followed by homogenizing at about 2,000 rpm. To this was added aluminum sulfate (about 0.5 pph), and the homogenizer was increased to about 4200 rpm at the end of the aluminum sulfate addition.

The mixture was then stirred at about 450 rpm with an overhead stirrer and placed in a heating mantle. The temperature was increased to about 30° C. over about a 30 minute period, during which period the particles grew to just below 3 microns.

The shell solution, including about 115 grams of the polyester emulsion of Example 1 along with about 50 grams of Millipore water and about 1.2 grams of DOWFAX™ 2A1 surfactant was pH adjusted using 0.3 M nitric acid to a pH of about 4.2. This shell solution was then added to the 2 liter kettle. The temperature was then increased in 2 degree increments until a particle size of about 3.5 microns was achieved. This occurred at around 38° C. A solution including sodium hydroxide in water (about 4% by weight of NaOH) was added to freeze the size (prevent further growth) until the pH of the mixture was about 4.

Following this, about 1.6 grams (0.75 pph) of a chelating agent, EDTA, was added to remove the aluminum and the pH was further adjusted using 4% NaOH to 7.2. During these additions, the stirrer speed was gradually reduced to about 160 rpm. The mixture was then heated to about 63° C. over about 60 minutes, and further to about 70° C. over about 30 minutes. The pH was decreased by increments of about 0.2 pH units by dropwise addition of an aqueous buffer solution of sodium acetate and acetic acid (original buffer pH adjusted to about 5.9 with acetic acid to achieve desired buffer ratio). These pH decreases occurred at about 44° C., about 50° C., about 56° C., about 62° C., and about 68° C., to reach a final pH of about 6.2. The mixture was set to coalesce at a final temperature of about 70° C. and at a pH of about 6.2. The resulting toner particles were of spherical morphology and displayed a size of about 3.68 microns with a GSD of about 1.22.

Example 4

An emulsion aggregation toner was prepared having about 83.7% of the polyester-photoinitiator resin of Example 1, about 11.8% of a crystalline polyester resin, and about 5.5% of Regal 330 Carbon Black pigment. The toner had about 28% of the polyester-photoinitiator resin in the shell.

A 2 liter kettle was charged with about 224 grams of the polyester emulsion of Example 1 (about 24.47% solids and having a particle size of about 138.8 nm). To this was added about 27.6 grams of a Regal 330 Carbon black dispersion of about 21.4% solids available from Cabot Corporation, about 175 grams of Millipore water, and about 2.9 grams of DOWFAX™ 2A1 surfactant (an alkyldiphenyloxide disulfonate from the Dow Chemical Company (about 47.1% aqueous solution), with stirring at about 100 rpm. To this mixture was added about 35.3 grams of the crystalline polyester resin emulsion of Example 2, with a solids content of 33.5%. To this was then added 0.3 M nitric acid solution, until a pH of about 4.2 was achieved, followed by homogenizing at about 2,000 rpm. To this was added aluminum sulfate (about 0.5 pph), and the homogenizer was increased to about 4200 rpm at the end of the aluminum sulfate addition.

The mixture was then stirred at about 450 rpm with an overhead stirrer and placed in a heating mantle. The temperature was increased to about 30° C. over about a 30 minute period, during which period the particles grew to just below 3 microns.

The shell solution, including about 112 grams of the polyester emulsion of Example 1 along with about 50 grams of Millipore water and about 1.2 grams of DOWFAX™ 2A1 surfactant was pH adjusted using 0.3 M nitric acid to a pH of about 4.2. This shell solution was then added to the 2 liter kettle. The temperature was then increased in 2 degree increments until a particle size of about 3.5 microns was achieved. This occurred at around 38° C. A solution including sodium hydroxide in water (about 4% by weight of NaOH) was added to freeze the size (prevent further growth) until the pH of the mixture was about 4.

Following this, about 1.6 grams (0.75 pph) of a chelating agent, EDTA, was added to remove the aluminum and the pH was further adjusted using 4% NaOH to 7.2. During these additions, the stirrer speed was gradually reduced to about 160 rpm. The mixture was then heated to about 63° C. over about 60 minutes, and further to about 70° C. over about 30 minutes. The pH was decreased by increments of about 0.2 pH units by dropwise addition of an aqueous buffer solution of sodium acetate and acetic acid (original buffer pH adjusted to about 5.9 with acetic acid to achieve desired buffer ratio). These pH decreases occurred at about 44° C., about 50° C., about 56° C., about 62° C., and about 70° C., to reach a final pH of about 6.1. The mixture was set to coalesce at a final temperature of about 70° C. and at a pH of about 6.2. The resulting toner particles were of spherical morphology and displayed a size of about 3.42 microns with a GSD of about 1.21.

Example 5

An emulsion aggregation toner was prepared having about 81.4% of the polyester-photoinitiator resin of Example 1, about 11.6% of a crystalline polyester resin, and about 7% of Yellow pigment. The toner had about 28% of the polyester-photoinitiator resin in the shell.

A 2 liter kettle was charged with about 220 grams of the polyester emulsion of Example 1 (about 24.47% solids and having a particle size of about 138.8 nm). To this was added about 40.8 grams of a Pigment Yellow 74 dispersion of about 18.7% solids, about 175 grams of Millipore water, and about 2.9 grams of DOWFAX™ 2A1 surfactant (an alkyldiphenyloxide disulfonate from the Dow Chemical Company (about 47.1% aqueous solution), with stirring at about 100 rpm. To this mixture was added about 34.6 grams of the crystalline polyester resin emulsion of Example 2, with a solids content of 33.5%. To this was then added 0.3 M nitric acid solution, until a pH of about 4.2 was achieved, followed by homogenizing at about 2,000 rpm. To this was added aluminum sulfate (about 0.5 pph), and the homogenizer was increased to about 4200 rpm at the end of the aluminum sulfate addition.

The mixture was then stirred at about 450 rpm with an overhead stirrer and placed in a heating mantle. The temperature was increased to about 30° C. over about a 30 minute period, during which period the particles grew to just below 3 microns.

The shell solution, including about 110 grams of the polyester emulsion of Example 1 along with about 50 grams of Millipore water and about 1.2 grams of DOWFAX™ 2A1 surfactant was pH adjusted using 0.3 M nitric acid to a pH of about 4.2. This shell solution was then added to the 2 liter kettle. The temperature was then increased in 2 degree increments until a particle size of about 3.5 microns was achieved. This occurred at around 38° C. A solution including sodium hydroxide in water (about 4% by weight of NaOH) was added to freeze the size (prevent further growth) until the pH of the mixture was about 4.

Following this, about 1.6 grams (0.75 pph) of a chelating agent, EDTA, was added to remove the aluminum and the pH was further adjusted using 4% NaOH to 7.2. During these additions, the stirrer speed was gradually reduced to about 160 rpm. The mixture was then heated to about 63° C. over about 60 minutes, and further to about 70° C. over about 30 minutes. The pH was decreased by increments of about 0.2 pH units by dropwise addition of an aqueous buffer solution of sodium acetate and acetic acid (original buffer pH adjusted to about 5.9 with acetic acid to achieve desired buffer ratio). These pH decreases occurred at about 44° C., about 50° C., about 56° C., about 62° C., and about 72° C., to reach a final pH of about 6.0. The mixture was set to coalesce at a final temperature of about 72° C. and at a pH of about 6.1. The resulting toner particles were of spherical morphology and displayed a size of about 3.53 microns with a GSD of about 1.23.

Example 6

An emulsion aggregation toner was prepared having about 78.8% of the polyester-photoinitiator resin of Example 1, about 11.2% of a crystalline polyester resin, and about 10% of Majenta pigment. The toner had about 28% of the polyester-photoinitiator resin in the shell.

A 2 liter kettle was charged with about 218 grams of the polyester emulsion of Example 1 (about 24.47% solids and having a particle size of about 138.8 nm). To this was added about 58.14 grams of a Pigment Red 269/122 majenta dispersion of about 17.2% solids available, about 175 grams of Millipore water, and about 2.9 grams of DOWFAX™ 2A1 surfactant (an alkyldiphenyloxide disulfonate from the Dow Chemical Company (about 47.1% aqueous solution), with stirring at about 100 rpm. To this mixture was added about 33.4 grams of the crystalline polyester resin emulsion of Example 2, with a solids content of 33.5%. To this was then added 0.3 M nitric acid solution, until a pH of about 4.2 was achieved, followed by homogenizing at about 2,000 rpm. To this was added aluminum sulfate (about 0.5 pph), and the homogenizer was increased to about 4200 rpm at the end of the aluminum sulfate addition.

The mixture was then stirred at about 450 rpm with an overhead stirrer and placed in a heating mantle. The temperature was increased to about 30° C. over about a 30 minute period, during which period the particles grew to just below 3 microns.

The shell solution, including about 109 grams of the polyester emulsion of Example 1 along with about 50 grams of Millipore water and about 1.2 grams of DOWFAX™ 2A1 surfactant was pH adjusted using 0.3 M nitric acid to a pH of about 4.2. This shell solution was then added to the 2 liter kettle. The temperature was then increased in 2 degree increments until a particle size of about 3.5 microns was achieved. This occurred at around 38° C. A solution including sodium hydroxide in water (about 4% by weight of NaOH) was added to freeze the size (prevent further growth) until the pH of the mixture was about 4.

Following this, about 1.6 grams (0.75 pph) of a chelating agent, EDTA, was added to remove the aluminum and the pH was further adjusted using 4% NaOH to 7.2. During these additions, the stirrer speed was gradually reduced to about 160 rpm. The mixture was then heated to about 63° C. over about 60 minutes, and further to about 70° C. over about 30 minutes. The pH was decreased by increments of about 0.2 pH units by dropwise addition of an aqueous buffer solution of sodium acetate and acetic acid (original buffer pH adjusted to about 5.9 with acetic acid to achieve desired buffer ratio). These pH decreases occurred at about 44° C., about 50° C., about 56° C., about 62° C., and about 70° C., to reach a final pH of about 6.1. The mixture was set to coalesce at a final temperature of about 71° C. and at a pH of about 6.0. The resulting toner particles were of spherical morphology and displayed a size of about 3.57 microns with a GSD of about 1.25.

TABLE 1

Full Color Set of UV Curable ULM Toners

| Toner Sample | Color | P.S. (Vol) | GSD (Vol) | GSD (Num) | Circularity | Pigment Loading |
|---|---|---|---|---|---|---|
| Example 3 | Cyan | 3.68 | 1.22 | 1.25 | 0.959 | 6 |
| Example 4 | Black | 3.42 | 1.21 | 1.23 | 0.971 | 5.5 |
| Example 5 | Yellow | 3.53 | 1.23 | 1.25 | 0.96 | 7 |
| Example 6 | Magenta | 3.57 | 1.25 | 1.28 | 0.961 | 10 |

Bench q/d and Cohesion Results

Each toner sample was blended on a sample mill for about 30 seconds at about 15000 rpm. Developer samples were prepared with about 0.5 grams of the toner sample and about 10 grams of the carrier. A duplicate developer sample pair was prepared as above for each toner that was evaluated. One developer of the pair was conditioned overnight in an A-zone environmental chamber (28° C./85% RH), and the other was conditioned overnight in the C-zone environmental chamber (10° C./15% RH). The next day the developer samples were sealed and agitated for about 2 minutes, followed by mixing for about 1 hour using a Turbula mixer. After the 2 minutes of agitation and 1 hour of mixing, the toner triboelectric charge was measured with a charge spectrograph using a 100 V/cm field. The toner charge (q/d) was measured visually as the midpoint of the toner charge distribution. The charge was reported in millimeters of displacement from the zero line. Following the 1 hour of mixing, an additional 0.5 grams of toner sample was added to the already charged developer, and mixed for a further 15 seconds, where a q/d displacement was again measured, and then mixed for a further 45 seconds (total 1 minute of mixing), and again a q/d displacement was measured.

Charging of the final toners was measured with a carrier, TK748 (35 μm, Core-EFC35B (Li—Mn ferrite), 1.6% RSM1585 (Methacrylate copolymer-CHMA/DMAEMA=99/1), 0.27% of a carbon black pigment, more specifically a conductive carbon black pigment sold as VULCAN® XC72R by Cabot, 0.21% Eposter S CCA (Melamine formaldehyde)), and an additive package (0.88% JMT2000 (15 μm titania), 1.71% RY50 (40 μm silica), 1.73% X24 (93 μm-130 μm SiO2 Sol-gel), 0.55% E10 (CeO2), 0.9% UADD (10-25 μm wax)) scaled proportionally for the smaller particle size.

Considering the smaller particle size, all toner charge levels and charge distribution widths (indicated by "error" bars, admix, and RH sensitivity) were within acceptable levels. Charge levels at 2 minutes and 60 minutes were close to the desired range of from about −4 to about −11.

Additive charge and cohesion data are set forth in FIGS. 1A-1D. FIG. 1A is for the cyan toner (Example 3); 1B is for the black toner (Example 4); 1C is for the magenta toner (Example 6); and 1D is for the yellow toner (Example 5).

Cohesion results were compared with commercially available emulsion aggregation toners DocuColor 250 from Xerox Corporation (Comparison Toner), including a resin based on a styrene/butyl acrylate copolymer. As can be seen in Table 2 below, the UV curable toners of the present disclosure showed significantly lower cohesion compared with the commercially available toner. This was unexpected, as smaller size toners typically have worse cohesion.

TABLE 2

| | Toner ID | % Cohesion |
|---|---|---|
| UV Curable | Example 3 | 22 |
| | Example 4 | 23 |
| | Example 5 | 13 |
| | Example 6 | 25 |
| Comparison Toner | DocuColor 250 Black | 34 |
| | DocuColor 250 Cyan | 62 |
| | DocuColor 250 Magenta | 42 |
| | DocuColor 250 Yellow | 54 |

Fusing Results

Unfused images were applied to two substrates (uncoated CX+ 90 gsm paper from Xerox (P/N 3R11540)) and coated DCEG 120 gsm paper (3R11450) with a modified DC-12 printer. A target TMA of 0.50±0.02 mg/cm$^2$ was achieved. Non-contact fusing of the images was achieved by a single pass under a radiant heater followed immediately by exposure to a high intensity UV light source. The IR emitters used in the test fixture were two Heraerus twin Carbon (2 micron peak wavelength) tube lamps. Print samples were carried under the IR and UV exposure stations at 60 mm/second (Note: Faster speeds could be used with additional lamps). UV exposure was made with a Fusion UV test system, Model 300 (300 watts/inch-sample 53 mm from irradiator, two UV bulbs) which had "H" medium pressure mercury lamps. Measured UV output in J/cm$^2$ was 0.126 (A wavelength), 0.119 (B), 0.013 (C) and 0.082 (V).

Crease Test

A standard crease area test procedure was used to evaluate toner adhesion to the substrate. A test sample was folded in half and a crease tool (about 960 gram metal cylinder) was rolled across the fold. The test sheet was unfolded and a cotton ball was wiped across the fractured surface to remove loose toner. Evaluation of the crease area was carried out using an image analysis system. (A standard crease area target (for normal paper) is 85 or below.) All measurements obtained for toners of the present disclosure exceeded this requirement, and the results on the CX+ paper were essentially 0 for all toners. The results are summarized below in Table 3.

TABLE 3

| Sample | Crease Area |
|---|---|
| EXAMPLE 3 CX+ | 0.66 |
| EXAMPLE 3 DCEG | 8.76 |
| EXAMPLE 4 CX+ | 0.1 |
| EXAMPLE 4 DCEG | 6.68 |
| EXAMPLE 5 CX+ | 0.08 |
| EXAMPLE 5 DCEG | 1.29 |
| EXAMPLE 6 CX+ | 0.09 |
| EXAMPLE 6 DCEG | 20.33 |

Document Offset

A document offset test was conducted to evaluate image robustness. The test simulated conditions that might be experienced in a warehouse or other storage areas. Sections of the non-contact fused prints, toner to toner, and toner to paper sections, were cut from the test sheets, 5 cm by 5 cm, and placed on a glass plate. A glass slide was then placed on top of the test samples (uncoated paper samples) after which a toner sample of about 80 g/cm$^2$ (2000 gram mass) was added and the sample was placed in a Hotpac environmental chamber with the temperature set to about 60° C. and relative humidity controlled at about 50% for about 24 hours.

Figure 2:
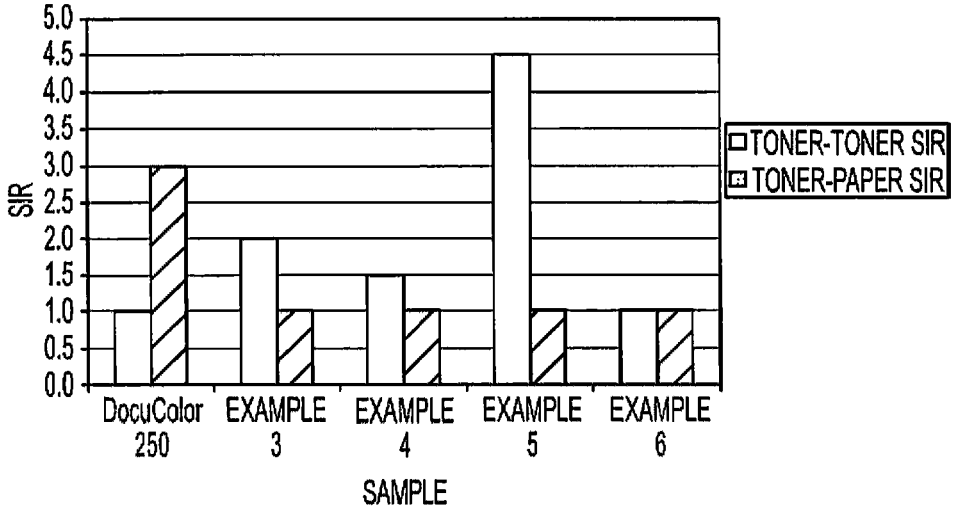
FIG. 2 is a graph of results of document offset testing conducted on uncured toners of the present disclosure and comparison toners.
Figure 3:
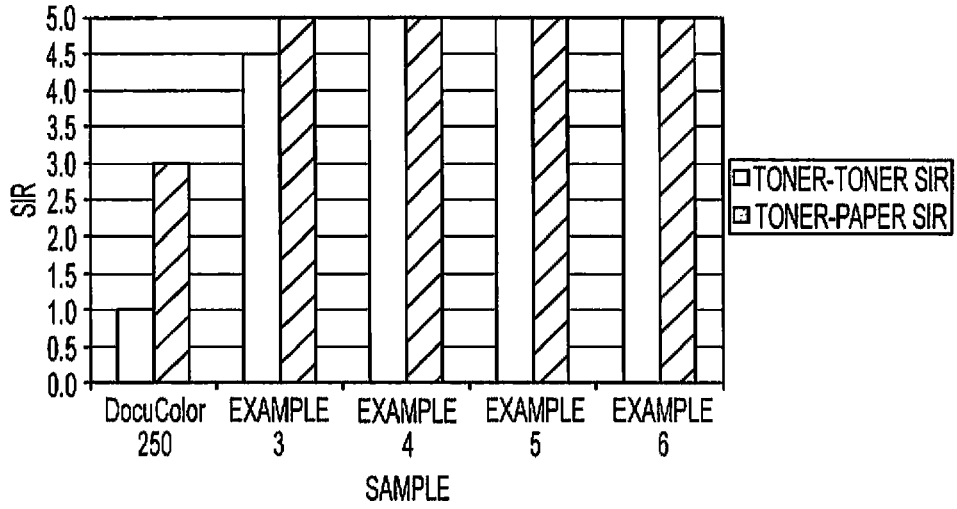
FIG. 3 is a graph of results of document offset testing conducted on cured toners of the present disclosure and comparison toners.

The document offset samples were cooled and then carefully peeled apart (at about a 180° peel angle) at a constant speed with the toner sheet on top. Document offset damage was evaluated with a Standard Image Reference (SIR) document. A SIR rank of 5 indicated the sample was not damaged, while a SIR ranking of 1 showed significant amounts of damage. Results for the uncured samples, as shown in FIG. 2, showed significant amounts of document offset damage (SIR was 1.5 and 1). The high ranking observed for toner-toner yellow toner was due to the difficulty of evaluating yellow toner damage. Cured images, the results of which are set forth in FIG. 3, showed no damage for toner to toner contact or toner to paper contact, and only the cyan toner to toner sheets appeared to be slightly stuck together. All other test samples did not stick together. Improved image robustness to document offset damage was found for the cured toners.

Car Manual Test

Another test was conducted to evaluate image robustness using conditions that printed documents might be subjected to if left in a glove compartment or in the trunk of a car. Test samples used coated paper as the substrate. Toner to toner and toner to paper sections for testing were cut from the print test sheets, having a size of 5 cm by 5 cm, and placed on a glass plate. A glass slide was then placed on top of the test samples after which about 2 g/cm$^2$ (50 gram mass) of toner was added and the sample was placed in a Test Equity environmental chamber.

In summary, the test included subjecting the sample to about 70% relative humidity; at about 2 g/cm$^2$ load; raising the temperature from about room temperature to 70° C. in about two hours; holding the sample at about 70° C. for about four hours; decreasing the temperature over about two hours to about −40° C.; holding the sample at about −40° C. for about four hours; and then repeating the whole test cycle.

Figure 4:
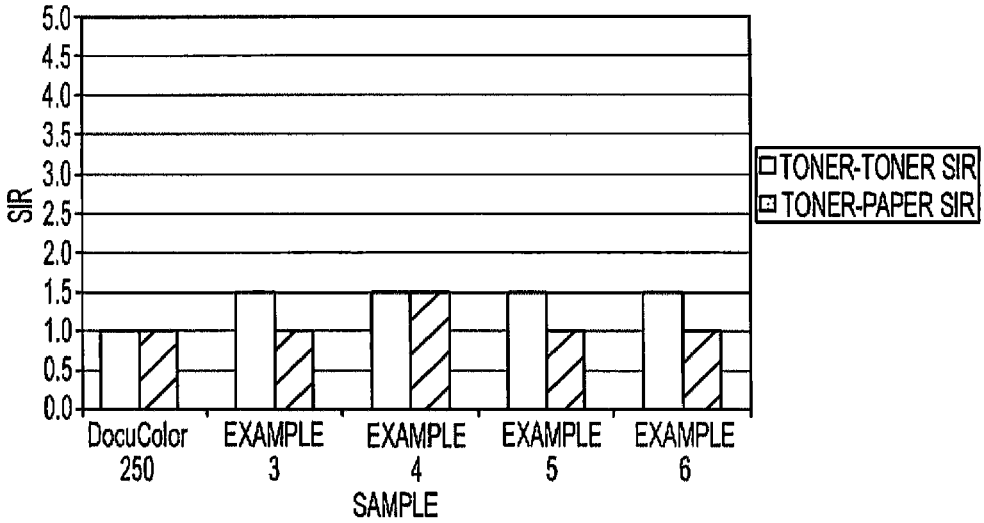
FIG. 4 is a graph of results of car manual document offset testing conducted on uncured toners of the present disclosure and comparison toners.
Figure 5:
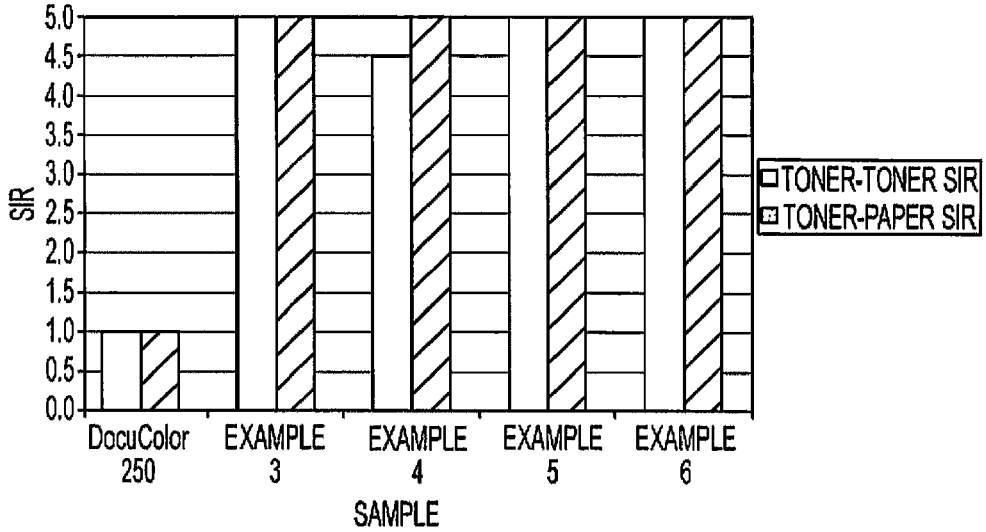
FIG. 5 is a graph of results of car manual document offset testing conducted on cured toners of the present disclosure and comparison toners.

After the samples were removed from the environmental chamber, the pages were peeled apart at a constant rate and a 180° peel angle. The sheet was placed against a flat surface, one edge lifted up, and then peeled back. Offset damage was again ranked using a standard image reference (SIR=5—no sticking or damage, to SIR=1—severe damage) for areas that saw toner to toner contact or toner to paper contact. As shown in the Audi Offset Uncured data provided as FIG. 4, all control samples had severe offset damage after the Car Manual test (SIR 1.5 or 1). As seen in FIG. 5, the UV cured toners were not damaged and for the most part the pages did not stick together (SIR=5). Only the black UV curable toner had pages that were slightly stuck together (SIR=4.5).

Heat Seal Test

A heat Seal/Lamination test was carried out for the test samples using a Sencorp bar/platen sealer, model 12-AS/1. The test simulated conditions that can occur during heat sealing of packaging materials. The top and bottom platen temperatures were set to the desired temperature, line pressure applied to platens was about 10 psi, and the sealing time was about 5 seconds. Test samples (toner to toner and toner to paper contact) on different substrates were placed in between the platens and pressure was applied for the desired time. After removing the test samples from the sealer, the print was allowed to cool to room temperature before being peeled and ranked for damage (R=severe damage, Y=some damage visible, G=no damage to the print).

Uncured toner samples were severely damaged. Cured samples did not show damage up to about 150° C., while some damage to the prints was found on coated paper for the prints heated to about 200° C. Greatly improved image robustness was found for UV curable toners that were cured. The amount of damage that occurred was substrate dependent. Results obtained are summarized below in Tables 4-8.

TABLE 4

| Uncured: 5 sec. @ 100 C., 10 PSI | | |
|---|---|---|
| Sample | Toner-Toner | Toner-Paper |
| EXAMPLE 3 CX+ | R | R |
| EXAMPLE 3 DCEG | R | R |
| EXAMPLE 4 CX+ | R | R |
| EXAMPLE 4 DCEG | R | R |
| EXAMPLE 5 CX+ | R | R |
| EXAMPLE 5 DCEG | R | R |

TABLE 4-continued

| Uncured: 5 sec. @ 100 C., 10 PSI | | |
|---|---|---|
| Sample | Toner-Toner | Toner-Paper |
| EXAMPLE 6 CX+ | R | R |
| EXAMPLE 6 DCEG | R | R |

TABLE 5

| Cured: 5 sec. @ 100 C., 10 PSI | | |
|---|---|---|
| Sample | Toner-Toner | Toner-Paper |
| EXAMPLE 3 CX+ | G | G |
| EXAMPLE 3 DCEG | G | G |
| EXAMPLE 4 CX+ | G | G |
| EXAMPLE 4 DCEG | G | G |
| EXAMPLE 5 CX+ | G | G |
| EXAMPLE 5 DCEG | G | G |
| EXAMPLE 6 CX+ | G | G |
| EXAMPLE 6 DCEG | G | G |

TABLE 6

| Cured: 5 sec. @ 150 C., 10 PSI | | |
|---|---|---|
| Sample | Toner-Toner | Toner-Paper |
| EXAMPLE 3 CX+ | G | G |
| EXAMPLE 3 DCEG | G | G |
| EXAMPLE 4 CX+ | G | G |
| EXAMPLE 4 DCEG | G | G |
| EXAMPLE 5 CX+ | G | G |
| EXAMPLE 5 DCEG | G | G |
| EXAMPLE 6 CX+ | G | G |
| EXAMPLE 6 DCEG | G | G |

TABLE 7

| Cured: 5 sec. @ 200 C., 10 PSI | | |
|---|---|---|
| Sample | Toner-Toner | Toner-Paper |
| EXAMPLE 3 CX+ | G | G |
| EXAMPLE 3 DCEG | G | G |
| EXAMPLE 4 CX+ | G | G |
| EXAMPLE 4 DCEG | G | Y |
| EXAMPLE 5 CX+ | G | G |

TABLE 7-continued

| Cured: 5 sec. @ 200 C., 10 PSI | | |
|---|---|---|
| Sample | Toner-Toner | Toner-Paper |
| EXAMPLE 5 DCEG | G | Y |
| EXAMPLE 6 CX+ | G | G |
| EXAMPLE 6 DCEG | G | G |

TABLE 8

| Cured: 0.6 sec. @ 204 C., 100 PSI | | |
|---|---|---|
| Sample | Toner-Toner | Toner-Paper |
| EXAMPLE 3 CX+ | G | G |
| EXAMPLE 3 DCEG | G | Y |
| EXAMPLE 4 CX+ | G | G |
| EXAMPLE 4 DCEG | Y | Y |
| EXAMPLE 5 CX+ | G | G |
| EXAMPLE 5 DCEG | G | Y |
| EXAMPLE 6 CX+ | G | G |
| EXAMPLE 6 DCEG | G | Y |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

contacting an emulsion comprising at least one amorphous polyester resin in combination with at least one crystalline polyester resin with an optional wax and an optional colorant, the emulsion having a particle size of from about 50 nm to about 200 nm and a solids content of from about 10% to about 50% by weight;

aggregating the particles by contacting the particles with from about 0.1 parts per hundred to about 2 parts per hundred of an aggregating agent selected from the group consisting of aluminum sulfate, polyaluminum chloride, polyaluminum bromide, polyaluminum fluoride, polyaluminum iodide, polyaluminum silicate, polyaluminum sulfosilicate, aluminum chloride, aluminum nitrite, aluminum sulfate, potassium aluminum sulfate, and combinations thereof to form aggregated particles;

contacting the aggregated particles with at least one unsaturated polymeric resin in combination with a photoinitiator to form a shell over the aggregated particles;

coalescing the aggregated particles to form toner particles; and recovering the toner particles.

2. The process according to claim 1, wherein the polymeric resin comprises an amorphous polyester resin.

3. The process according to claim 1, wherein the polymeric resin comprises a crystalline polyester having a number average molecular weight of from about 1,000 to about 50,000, a weight average molecular weight of from about 2,000 to about 100,000, and a molecular weight distribution (Mw/Mn) of from about 2 to about 6.

4. The process according to claim 1, wherein the wherein the polymeric resin comprises an amorphous polyester resin of the formula:

(I)

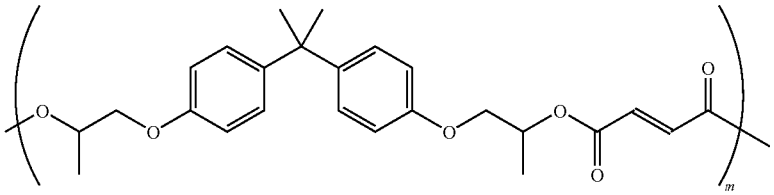

wherein m may be from about 5 to about 1000, in combination with a crystalline polyester resin of the formula:

(II)

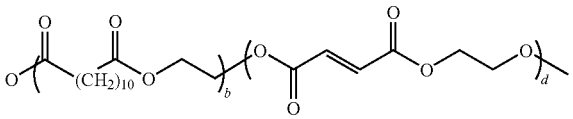

wherein b is from about 5 to about 2000 and d is from about 5 to about 2000.

5. The process according to claim 1, wherein the photoinitiator is selected from the group consisting of hydroxycyclohexylphenyl ketones, other ketones, benzoins, benzoin alkyl ethers, benzophenones, trimethylbenzoylphenylphosphine oxides, azo compounds, anthraquinones, substituted anthraquinones, other substituted or unsubstituted polynuclear quinines, acetophenones, thioxanthones, ketals, acylphosphines, and mixtures thereof.

6. The process according to claim 1, wherein the photoinitiator is selected from the group consisting of alpha-amino ketone, 4-(2-hydroxyethoxy)phenyl-(2-hydroxy-2-propyl) ketone, 2,4,6-trimethylbenzophenone, 4-methylbenzophenone, 2,4,6-trimethylbenzoyl-diphenyl-phosphine oxide, phenylbis(2,4,6-trimethylvbenzyoyl) phosphine oxide, alkyl substituted or halo substituted anthraquinones, 2-hydroxy-2-methyl-1-phenyl-propan-1-one, 2-isopropyl-9H-thioxanthen-9-one, 2-Hydrox-4'-hydroxyethoxy-2-methylpropiophenone, 1-hydroxycyclohexylphenyl ketone, ethyl-2,4,6-trimethylbenzoylphenylphosphinate, and mixtures thereof.

7. The process according to claim 1, wherein the polymeric resin is present in an amount of from about 65 percent by weight to about 95 percent by weight of the toner particles and the photoinitiator is present in an amount of from about 0.5 percent by weight to about 15 percent by weight of the toner particles.

8. The process according to claim 1, wherein the toner particles possess a Number Average Geometric Standard Deviation or Volume Average Geometric Standard Deviation of from about 1.18 to about 1.30.

9. The process according to claim 1, wherein the toner particles have a gloss of from about 20 ggu to about 100 ggu.

10. The process according to claim 1, wherein the aggregating agent comprises aluminum sulfate.

11. A process comprising:

contacting an emulsion comprising at least one amorphous polyester resin in combination with at least one crystalline polyester resin with an optional wax and an optional colorant, the emulsion having a particle size of from about 50 nm to about 200 nm and a solids content of from about 10% to about 50% by weight;

aggregating the particles by contacting the particles with from about 0.1 parts per hundred to about 2 parts per hundred of an aggregating agent selected from the group consisting of aluminum sulfate, polyaluminum chloride, polyaluminum bromide, polyaluminum fluoride, polyaluminum iodide, polyaluminum silicate, polyaluminum sulfosilicate, aluminum chloride, aluminum nitrite, aluminum sulfate, potassium aluminum sulfate, and combinations thereof to form aggregated particles;

contacting the aggregated particles with at least one unsaturated polymeric resin in combination with a photoinitiator to form a shell over the aggregated particles;

coalescing the aggregated particles to form toner particles;

recovering the toner particles;

applying the toner particles to a substrate; and fusing the toner particles to the substrate by non-contact fusing to form an image on the substrate, wherein the toner has a gloss of from about 20 ggu to about 100 ggu and the image on the substrate has a toner pile height of from about 1 micron to about 6 microns.

12. The process according to claim 11, wherein the polymeric resin comprises an amorphous polyester resin.

13. The process according to claim 11, wherein the polymeric resin comprises a crystalline polyester having a number average molecular weight of from about 1,000 to about 50,000, a weight average molecular weight of from about 2,000 to about 100,000, and a molecular weight distribution (Mw/Mn) of from about 2 to about 6.

14. The process according to claim 11, wherein the wherein the polymeric resin comprises an amorphous polyester resin of the formula:

(I)

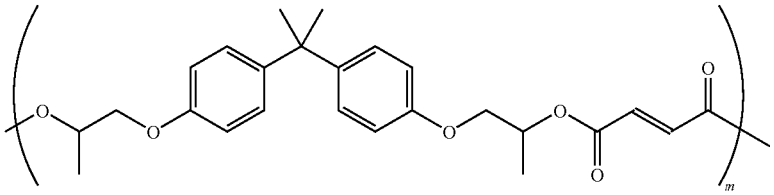

wherein m may be from about 5 to about 1000, in combination with a crystalline polyester resin of the formula:

(II)

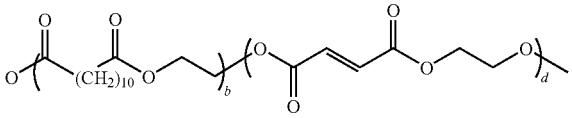

wherein b is from about 5 to about 2000 and d is from about 5 to about 2000.

15. The process according to claim 11, wherein the photoinitiator is selected from the group consisting of hydroxycyclohexylphenyl ketones, other ketones, benzoins, benzoin alkyl ethers, benzophenones, trimethylbenzoylphenylphosphine oxides, azo compounds, anthraquinones, substituted anthraquinones, other substituted or unsubstituted polynuclear quinines, acetophenones, thioxanthones, ketals, acylphosphines, and mixtures thereof.

16. The process according to claim 11, wherein the photoinitiator is selected from the group consisting of alpha-amino ketone, 4-(2-hydroxyethoxy)phenyl-(2-hydroxy-2-propyl) ketone, 2,4,6-trimethylbenzophenone, 4-methylbenzophenone, 2,4,6-trimethylbenzoyl-diphenyl-phosphine oxide, phenylbis(2,4,6-trimethylvbenzyoyl) phosphine oxide, alkyl substituted or halo substituted anthraquinones, 2-hydroxy-2-methyl-1-phenyl-propan-1-one, 2-isopropyl-9H-thioxanthen-9-one, 2-Hydrox-4'-hydroxyethoxy-2-methylpropiophenone, 1-hydroxycyclohexylphenyl ketone, ethyl-2,4,6-trimethylbenzoylphenylphosphinate, and mixtures thereof.

17. The process according to claim 11, wherein the polymeric resin is present in an amount of from about 65 percent by weight to about 95 percent by weight of the toner particles and the photoinitiator is present in an amount of from about 0.5 percent by weight to about 15 percent by weight of the toner particles.

18. The process according to claim 11, wherein the toner particles possess a Number Average Geometric Standard Deviation or Volume Average Geometric Standard Deviation of from about 1.18 to about 1.30.

19. The process according to claim 11, wherein the aggregating agent comprises aluminum sulfate.

20. The process according to claim 11, wherein the image on the substrate has a toner pile height of from about 2 microns to about 4 microns.

* * * * *